US005435600A

United States Patent [19]

Griffiths et al.

[11] Patent Number: 5,435,600

[45] Date of Patent: Jul. 25, 1995

[54] PRESCRIPTION PHARMACY

[75] Inventors: Sam Griffiths, Angola, Ind.; Paul A. Phillips, Antioch, Calif.; R. James Weber, Livingston, N.J.

[73] Assignee: Moore Business Forms, Inc., Grand Island, N.Y.

[21] Appl. No.: 96,815

[22] Filed: Jul. 28, 1993

[51] Int. Cl.[6] ..... B42D 15/08

[52] U.S. Cl. ..... 283/81; 283/58; 283/61; 283/62; 283/66.2; 283/101; 283/106; 281/2; 281/5; 462/15; 462/16; 462/28; 462/44; 462/68; 462/69; 428/40; 503/206

[58] Field of Search ..... 283/57–59, 283/60.1, 60.2, 61, 62, 66.1, 66.2, 79, 81, 101, 106; 281/2, 5; 462/8, 15, 16, 28, 39, 44, 68, 69, 900; 428/40; 503/206

[56] References Cited

U.S. PATENT DOCUMENTS

| | | | |
|---|---|---|---|
| Re. 30,958 | 6/1982 | White . | |
| 1,581,170 | 4/1926 | Burdell . | |
| 2,706,865 | 4/1955 | Miller . | |
| 2,983,525 | 5/1961 | Mercur . | |
| 3,226,862 | 1/1966 | Gabruk . | |
| 3,625,547 | 12/1971 | Burke | 283/81 X |
| 3,702,511 | 11/1972 | Miller | 283/81 X |
| 3,946,507 | 3/1976 | Fergg et al. . | |
| 4,128,954 | 12/1978 | White . | |
| 4,159,129 | 6/1979 | Lockhart . | |
| 4,204,706 | 5/1980 | Blum et al. . | |
| 4,277,089 | 7/1981 | Lockhart . | |
| 4,323,608 | 4/1982 | Denny et al. . | |
| 4,621,837 | 11/1986 | Mack . | |
| 4,674,771 | 6/1987 | Thompson, II . | |
| 4,711,686 | 12/1987 | Instance . | |
| 4,748,147 | 5/1988 | Sumi-I et al. | 503/206 X |
| 4,762,342 | 8/1988 | Thompson | 462/18 X |
| 4,799,712 | 1/1989 | Biava et al. | 283/81 X |
| 4,996,184 | 2/1991 | Bevan et al. | 281/2 X |
| 5,048,870 | 9/1991 | Mangini et al. | 283/81 |
| 5,090,943 | 2/1992 | Greig et al. | 462/84 X |
| 5,137,494 | 8/1992 | Schubert et al. . | |
| 5,154,668 | 10/1992 | Schubert | 462/66 X |
| 5,182,152 | 1/1993 | Ericson . | |
| 5,197,922 | 3/1993 | Schubert | 462/56 X |
| 5,224,897 | 7/1993 | Linden et al. . | |
| 5,267,898 | 12/1993 | Doll et al. | 462/26 X |

FOREIGN PATENT DOCUMENTS

| | | | |
|---|---|---|---|
| 59-35981 | 2/1984 | Japan | 503/206 |
| 1569625 | 6/1980 | United Kingdom | 462/39 |

*Primary Examiner*—Frances Han
*Attorney, Agent, or Firm*—Nixon & Vanderhye

[57] ABSTRACT

A prescription pharmacy label comprises a face stock having top and bottom faces with a pressure sensitive adhesive on at least a major portion of the bottom face, and a release liner engaging the pressure sensitive adhesive. A CB coating is provided on a first portion of the top face, and a CF coating on a second portion of the top face, separated by a first fold line, and a third portion of the top face is uncoated. A second fold line is provided in the release liner so that the label may be Z-folded about the fold lines so that the CB and CF coatings are in face-to-face engagement, and underlie the third portion, so that handwriting provided on the third portion is transferred to the CF coating on the second portion. A slit may be provided between the first and third portions to allow part of the adhesive on the bottom face of the third portion to be exposed and to be moved into contact with a prescription medicine container (e.g. bottom) to hold the label in contact with the container while the handwriting is being applied to the third portion, and then the entire release liner can be removed from underneath the third portion and the entire third portion pressed into engagement with the container, while the first and second portions are useful as a further label.

24 Claims, 4 Drawing Sheets

PRESCRIPTION PHARMACY

BACKGROUND AND SUMMARY OF THE INVENTION

Labels, with pressure sensitive adhesive, are a very versatile type of business form that are used in a wide variety of environments. One environment in which they are particularly useful is in the labeling of prescription medicines, such as pharmaceuticals, ointments, and the like. Oftentimes it is necessary to provide variable information on containers for prescription medicines, and to have a record of the variable information that is provided, and in fact to be able to apply that same information in other areas, for example as a label on a record-keeping document, another container, or the like.

There are often times when it is also desirable to utilize labels for containers containing prescription medicines so that variable information is imaged thereon by a non-impact printer, which applies heat, such as a laser printer in which the toner is fused by the application of heat (e.g. a Hewlett-Packard Laser Jet III printer). It is highly desirable to be able to print labels in an efficient manner utilizing such a printer, while at the same time providing the label with image transfer capabilities provided by carbonless coating having microcapsules filled with dye and developer.

According to the present invention, a label is provided which can be passed through a laser printer to have variable indicia imaged thereon, yet the label is capable of providing carbonless image transfer. The label is also readily adapted to be applied to a container for prescription medicine, and handwritten entries may be provided on the label while initially applied to the container, which handwritten entries are transferred to other portions of the label. Then the portions of the label to which the handwriting has been transferred may be removed from the original-handwritten containing portion, so that a label is positively applied to the container, yet record information containing what is on that label is provided on a separate label, which in turn can be used for record-keeping purposes and/or applied to another substrate. According to the present invention a versatile, useful, label type business form construction is provided.

According to a first aspect of the present invention there is a label which comprises the following elements: A face stock having top and bottom faces. Pressure sensitive adhesive on at least a major portion of the bottom face. A release liner engaging the pressure sensitive adhesive. A CB coating on a first portion of the top face. And a CF coating on a second portion of the top face. A first fold line is preferably formed in the face stock and release liner between the first and second portions, for allowing the face stock and release liner to be folded about the first fold line so that the CB coating comes into face-to-face contact with the CF coating.

The face stock also preferably comprises a third, uncoated, portion distinct from the first and second portions, and a slit formed in the face stock but not the release liner, separating the third portion from the first and second portions. A second fold line is provided in the release liner underlying or adjacent the third portion of the face stock, the second and first fold lines allowing Z-folding of the release liner to bring the CB and CF coatings beneath the third portion so that indicia written on the third portion is transferred to the second portion. Also pre-printed indicia may be provided on the second and third portions and spaced along the face stock so that the pre-printed indicia on the second portion underlies the corresponding pre-printed indicia on the third portion when the release liner is Z-folded about the first and second fold lines, and the second fold line is spaced from the slit, underlying the third portion. Typically the pressure sensitive adhesive is provided on the bottom face of all of the first, second, and third portions of the face stock.

Typically, the first and second portions are substantially immediately adjacent each other and are separated by the first fold line (which may comprise a perforation line). Also the third portion is preferably substantially immediately adjacent the first portion on the opposite side thereof from the second portion, and is separated from the first portion by the slit.

The label may be part of a sheet containing a number of identical labels. The label typically has first and second substantially parallel long edges, and first and second substantially parallel short edges. The label in an integral sheet is connected to identical labels along the first and second long edges thereof, first and second lines of weakness formed in the sheet at the first and second long edges to facilitate detachment of the sheet into individual labels. Means are also preferably provided in the sheet defining polygonal shaped cut outs in the sheet at the first fold line so as to define each of the first and second portions so that they have a first width along a portion thereof, and thin down to a second width, substantially less than the first width, at the first fold line.

According to another aspect of the present invention, a combination is provided. The combination elements comprise: A container (e.g. a bottle) for prescription medicine, and a label connected to the container. The label itself comprises: A face stock having top and bottom faces. A pressure sensitive adhesive on the bottom face. A first portion of the top face having a CB coating. A second portion of the top face having a CF coating, the second portion substantially immediately adjacent the first portion and separated by a first fold line. A third portion substantially immediately adjacent the first portion on the opposite side thereof from the second portion, and separated from the first portion by a slit. A release liner covering the first and second portions, and including the first fold line, and also including a second fold line underlying the third portion and spaced from the slit. The label folded about the first and second fold lines to provide a tab portion of the third portion between the slit and the second fold line, the tab portion having the second face thereof in engagement with the container, so that the pressure sensitive adhesive on the bottom face of the tab portion attaches the label to the container. And the release liner, with attached first and second portions, Z-folded about the first and second fold lines so that the CB and CF coatings underlie part of the third portion, remote from the tab portion, so that indicia written on the third portion is transferred to the second portion.

The label in the combination may comprise corresponding pre-printed indicia provided on the second and third portions, and spaced along the face stock so that the pre-printed indicia on the second portion underlies the corresponding pre-printed indicia on the first portion when the release liner is Z-folded about the first and second fold lines. The pre-printed indicia may include a line and associated alpha numeric indicia for a doctor's name, a line and associated alpha numeric indicia for a patient's name, and a line and associated alpha numeric indicia for a date.

According to yet another aspect of the present invention, a method of associating a label with a container for prescription medicine utilizing a sheet containing a plurality of labels with CB, CF, and uncoated portions on the top face thereof, using a non-impact printer which applies heat during the printing process, is provided. The method comprises the following steps: (a) Passing the sheet through the printer to image variable information on the third portion of the face stock, without significantly adversely affecting the image transfer ability of the CB and CF coatings. Then, (b) separating one of the labels of the sheet from the rest of the sheet. Then, (c) exposing a part of the adhesive on the bottom face of part of the third portion of the label face stock by separating it from the release liner thereat. (d) Z-folding the label so that the CB and CF coatings underlie a part of the third portion of the label. (e) Pressing the exposed part of the adhesive onto the container for prescription medicine. And, (f) handwriting indicia on the part of the third portion of the label overlying the first and second portions so that the written indicia is transferred to the second portion. Then, (g) detaching the first and second portions from the third portion. And, (h) removing the release liner from the entire third portion, and pressing the adhesive thereon into association with the container.

There may also be the further step (i), prior to coating of the first and second portions of the CB and CF coatings, of imaging corresponding static indicia on that part of the third portion that overlies the second portion, and that part of the second portion that it overlies, so that the static indicia are in alignment after the practice of step (d). The indicia may be as described above (a line and associated alpha numeric indicia for a doctor's name, etc.).

The invention also contemplates a business form comprising a paper substrate having a top face and a bottom face. First indicia is imaged on the top face, and a CB coating is provided on a first portion of the top face, and a CF coating on a second portion of the top face. There is a third uncoated portion of the top face (on which at least part of the first indicia may be provided), and second indicia is printed on the bottom face. The CB and CF coatings preferably are on opposite sides of a fold line (typically a perforation line) and are such that heat from a non-impact (e.g. laser) printer may be applied without adversely affecting the image transferring ability thereof. When the form is folded about the fold line, the CB and CF coatings are brought into face to face contact with each other.

It is the primary object of the present invention to provide a versatile label, and in particular one that is useful in combination with a container for prescription medicine, and can be produced by passing it through a non-impact printer. This and other objects of the invention will become clear from an inspection of the detailed description of the invention and from the appended claims.

DETAILED DESCRIPTION OF THE DRAWINGS

Figure 1:
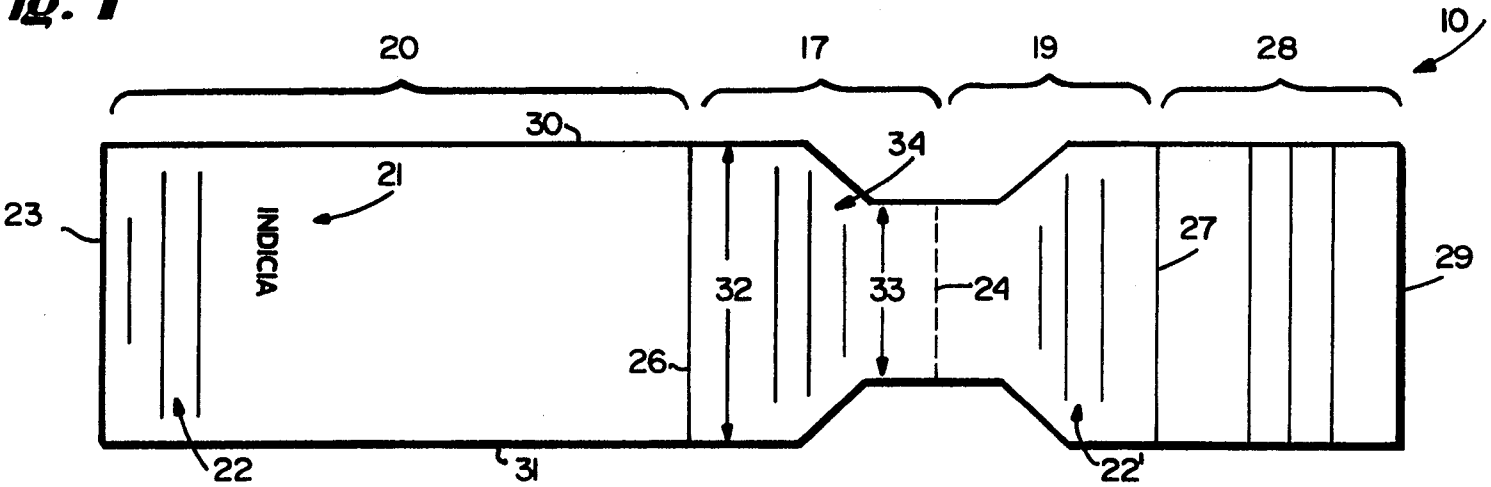
FIG. 1 is a top plan view of an exemplary label according to the present invention.
Figure 2:
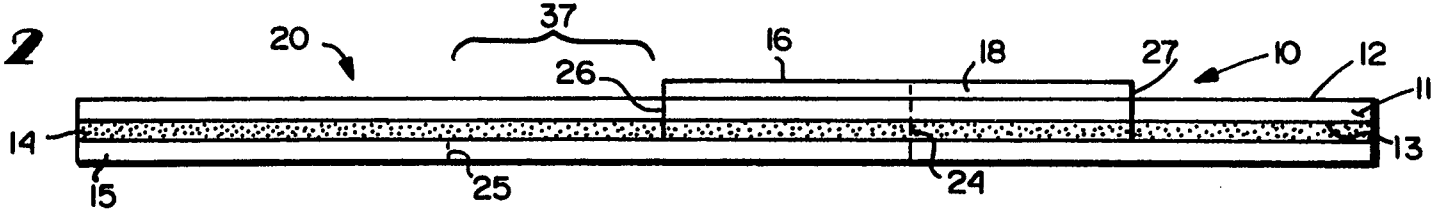
FIG. 2 is a side view of the label of FIG. 1 with the components thereof shown greatly exaggerated in thickness for clarity of illustration.
Figure 3:
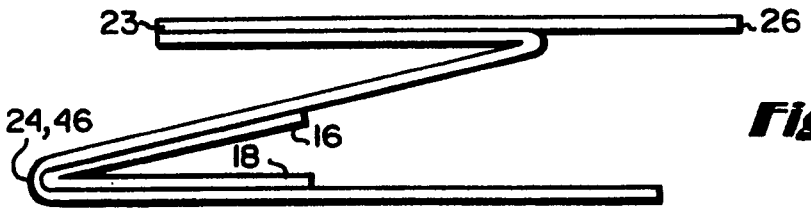
FIG. 3 is a schematic side view of the label of FIGS. 1 and 2 shown Z-folded and ready to be applied to a container for prescription medicine.

In the first sheet of drawings, FIGS. 1 through 3 are aligned to illustrate the relative positions of the various components thereof for ease of understanding of the label construction, and Z-folding thereof to a first configuration. The label of FIGS. 1 through 3 is shown generally by reference numeral 10. As seen most clearly in FIG. 2, the label includes a face stock 11 having a top surface or face 12 and a bottom face or surface 13. A pressure sensitive adhesive 14 is provided on the bottom face 13 of the face stock 11, at least over a major portion thereof, but preferably over substantially the entire face 13. Disposed in association with the pressure sensitive adhesive 14 is a conventional release liner 15. While the face stock 11 may be made from a variety of materials, preferably it is paper, and the pressure sensitive adhesive 14 may be permanent adhesive, removable adhesive, or repositional adhesive depending upon the ultimate requirements of the end user. The conventional release sheet 15 is preferably a silicone coated paper.

According to the present invention, image transfer means are provided associated with the label 10 by placing both a CB and CF coating on the same face, the top face 12, of the face stock 11. The CB coating seen at reference numeral 16 in FIG. 2, preferably covers an entire first portion 17 (see FIG. 1) of the label 10, while the CF coating is illustrated at 18 in FIG. 2 and preferably covers the entire second portion 19 of the label 10. The CB and CF coatings are constructed so that they can stand the heat applied by a conventional non-impact printer (such as the heat for fusing toner applied by a laser printer, such as a HP Laser Jet III printer). One suitable material from which the label 10 can be constructed is WH 46 #SLR 50 MF LP 430 from Fasson, Roll Division, Painesville, Ohio.

The label 10 face stock 11 also comprises a third portion 20 of the face stock 11 that is uncoated with CB or CF microcapules. Also provided on the top face 12 is preferably static indicia such as the general indicia 21, and also preferably corresponding indicia 22, 22' provided on that portion of the third portion 20 closest to the side edge 23 of the label 10, and underneath the CF coating 18. Indicia 22, 22' may include (as is clear from FIGS. 4 and 6) a line with associated alpha numeric indicia for a doctor's name, a line and associated alpha numeric indicia for a patient's name, and a line and associated alpha numeric indicia for a date.

The label 10 also has fold lines to facilitate Z-folding thereof. A first fold line, which preferably is a perforation line, is line 24, seen in FIGS. 1 through 3 and 6. The fold line 24 is both in the face stock 11 and the release liner 15. A second fold line is also provided. In the preferred embodiment illustrated in the drawings, the second fold line 25 (see FIGS. 2 and 3, and the dotted line configuration in FIG. 4) is provided only in the release liner 15. The second fold line 25 is spaced from a slit 26 formed in the face stock 11 (but not the release liner 15) which separates the third portion 20 from the first portion 17. If desired, a second slit 27 (see FIGS. 1 and 2) also may be provided separating the second portion 19 from a remaining portion 28 of the label 10.

As seen in the drawings, the label 10 has a short edge 29 parallel to the short edge 23, and two long side edges 30, 31, parallel to each other and perpendicular to the edges 23, 29. The first and second portions 17, 19 are substantially immediately adjacent each other, separated only by the fold line 24 (although there can be a small discontinuous portion on either side of the line 24), and preferably the portions 17, 19 have a first width 32 (the same as the width of the third portion 20—see FIG. 1), but thin down to a second width 33 substantially less than the first width. Also, static indicia 34 can be provided on the first portion 17 (see FIGS. 1 and 6) that does not align exactly with the indicia 22, 22' but can be basically the same indicia, for allowing copying of the indicia that is handwritten on second portion 19 in association with the indicia 22' as will be hereinafter described.

Figure 4:
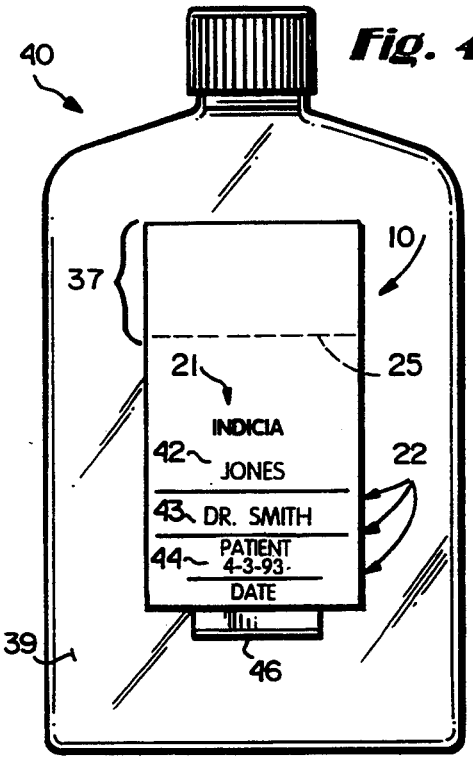
FIG. 4 is a front view of the label in the configuration of FIG. 3 applied to a bottle for prescription medicine.
Figure 5:
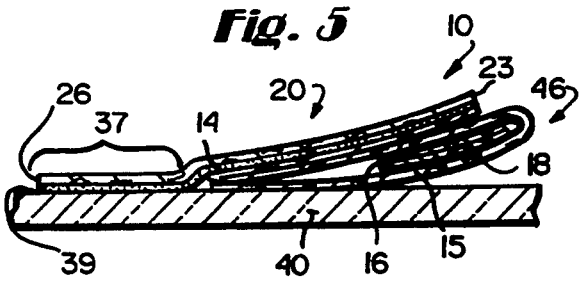
FIG. 5 is a detail cross-sectional view of the label and bottle combination of FIG. 4.

To use the label 10, one first bends the label 10 slightly so as to crack the face stock 11 at the slit 26, and then the label is carefully folded about the first fold line 24 and a second fold line 25, so that it has the configuration illustrated in FIGS. 3 and 5, with the third portion 20 overlying the first and second portions 17, 19, and with the CB and CF coatings 16, 18 in face-to-face engagement therewith and so that the indicia 22' is directly below the indicia 22. When folded in this manner, a tab portion 37 comprises part of the third portion 20, and the tab portion 37 has exposed pressure sensitive adhesive 14 on the under side thereof. The adhesive on the tab portion 37 is then pressed into contact with a surface 39 (see FIG. 4) of a container 40 for prescription medicine. The container 40 illustrated in FIGS. 4 through 5 is a bottle, but the container 40 may take other configurations, such as a box, tube, or the like. FIG. 5 illustrates the label 10 in the configuration of FIGS. 3 and 4 applied to the surface 39.

With the label 10 in the position illustrated in FIGS. 4 and 5, it is now ready to receive handwritten indicia. In the exemplary embodiment illustrated in FIG. 4, the handwritten indicia comprises the doctor's name 42, patient's name 43, and date 44. Of course other indicia could be provided, such as a particular species or dosage of the prescription medicine within the container 40 (although the particular medicine is normally variably imaged on the face 12 of the third portion 20, as indicated by reference numeral 21 in FIG. 1). Because of the CB 16 and CF 18 underlying coatings, this handwritten indicia 42–44 is transferred onto the second portion 19, as indicated by the handwritten indicia 42', 43' and 44' in FIG. 7.

Figure 6:
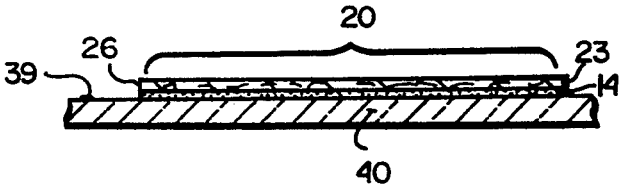
FIG. 6 is a view like that of FIG. 5 only after the first and second portions of the label have been removed and the third portion is in full adhesive engagement with the bottle.
Figure 7:
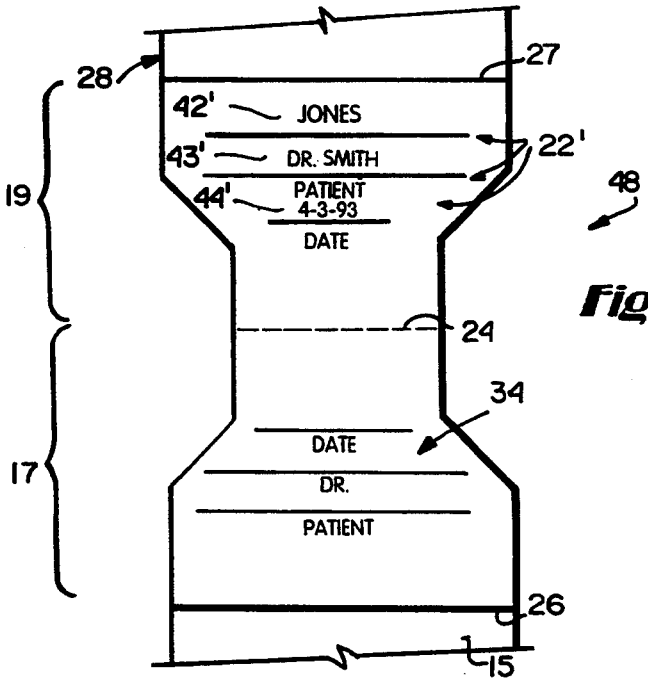
FIG. 7 is a plan view of the portions of the label from FIG. 5 which have been separated to result in the configuration of FIG. 6.

Once the handwritten indicia 42–44, 42'–44' has been applied as indicated in FIG. 4, the release liner 15 extending past the edge 23 of the top portion 20 (this exposed portion of the release liner 15 being illustrated generally at reference numeral 46 in FIG. 5) is grasped and the release liner 15 is detached from the rest of the third portion 20 (having earlier been detached from the tab portion 37). This allows one to press on the face stock 11 to smooth the entire third portion 20 of the label onto the surface 39 of the container 40 so that the pressure sensitive adhesive 14 uniformly holds the third portion 20 in contact with the surface 39 as illustrated in FIG. 6. The remaining portion of the label is illustrated in FIG. 7, generally by reference numeral 48. This remaining portion of the label 48 may be used in a wide variety of manners. For example, the handwritten indicia 42'–44' may be copied onto the first portion 17, at the indicia 34, and the first and second portions 17, 19 may be detached at the first fold line/perforation 24. They may then be individually peeled from the release liner 15 and placed into contact with different surfaces, or they may contain different indicia and be placed into contact with the same surface (e.g. a record document, another container, a shelf, etc.). Also, if desired, that part of the face stock forming the portion 28 may similarly be detached and used for other purposes.

Figure 8:
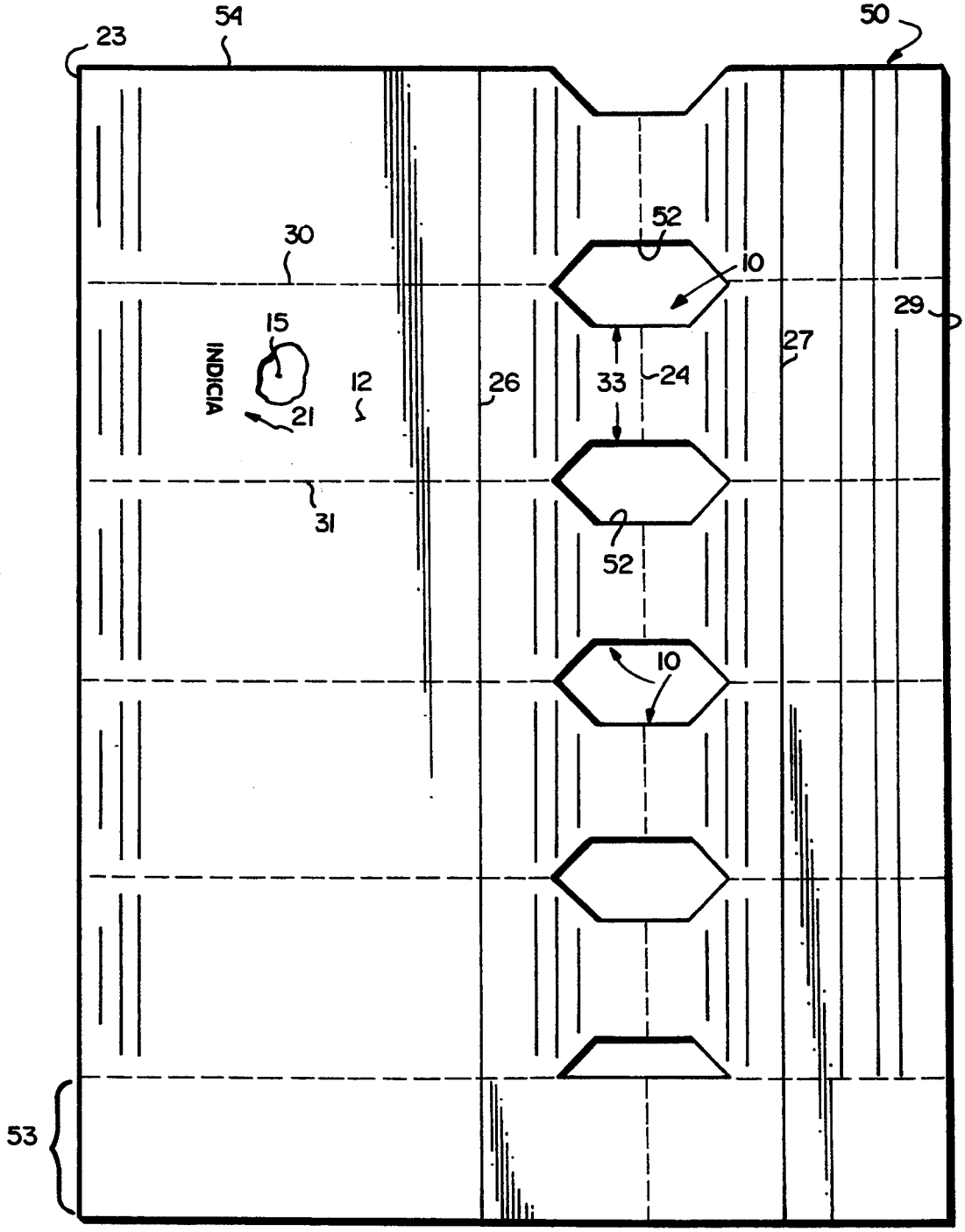
FIG. 8 is a top plan view of the label of FIG. 1 shown as part of a sheet of interconnected labels adapted to be fed through a non-impact printer.

FIG. 8 illustrates a sheet 50 which contains a plurality of labels 10. Long edges 30, 31 of the label 10 are defined by perforation lines in the sheet, which perforation lines also extend through the release liner 15. Note that in the sheet 50, the thinned portion 33 of the label 10 is defined by polygonal shaped (e.g. hexagonal) cut out 52 formed at the edges 30, 31 adjacent the first fold line 24.

The sheet 50 can easily be fed through a non-impact (e.g. laser) printer to have variable indicia 21 imaged thereon, and for that purpose a leading edge segment 53, which does not comprise a part of the labels 10, may be provided. Also the sheets 50 can be in continuous form, that is the leading edge portion 53 of one sheet 50 can be attached by a perforation line or the like to the trailing edge 54 of the next sheet 50.

Figure 9:
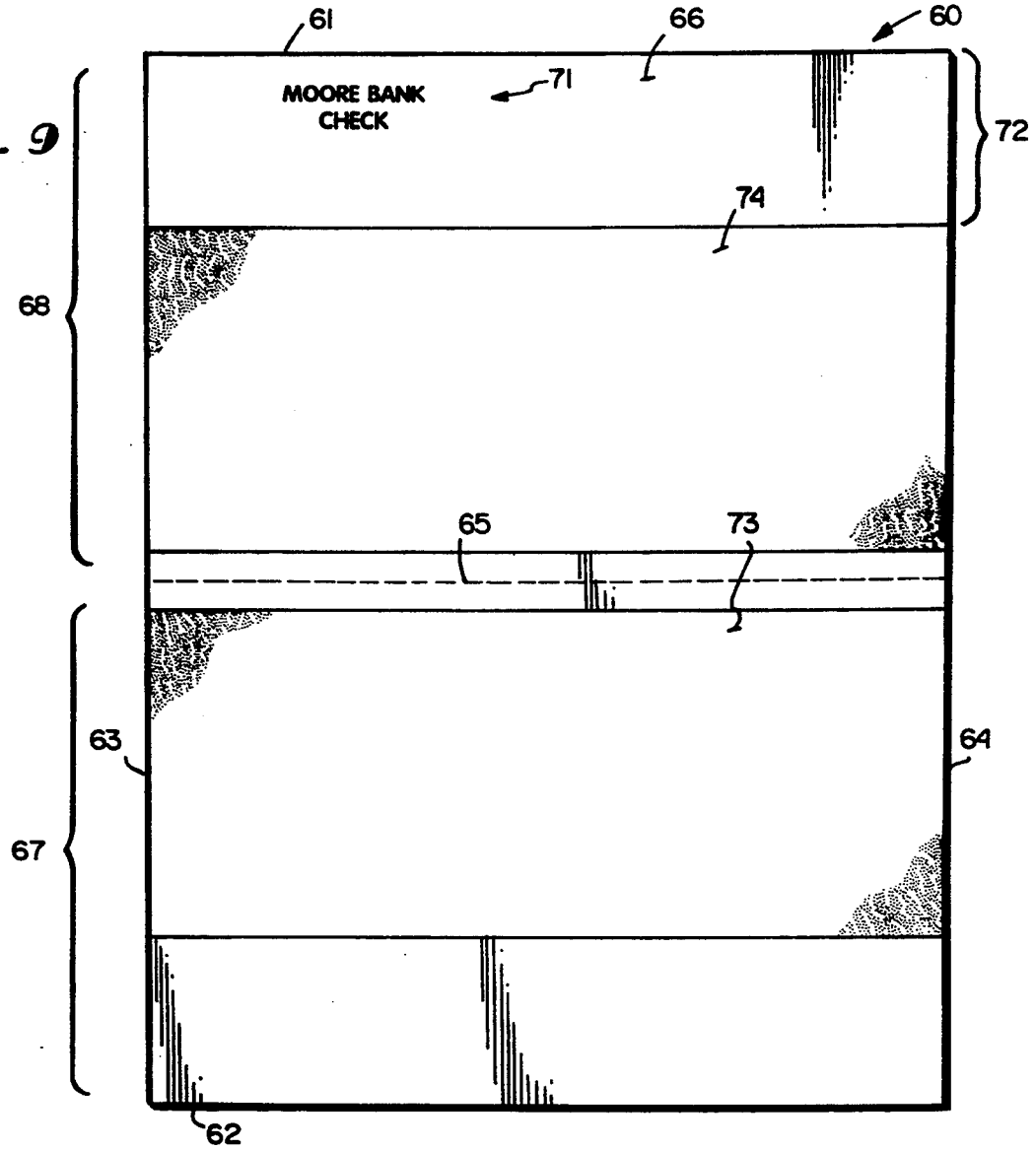
FIG. 9 is a top plan view of another embodiment of a business form according to the present invention.
Figure 10:
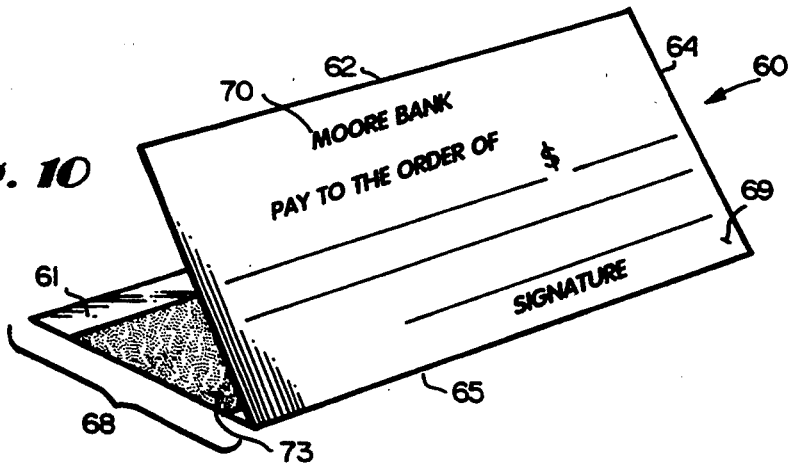
FIG. 10 is a perspective view of the form of FIG. 10 shown folded about a fold line thereof.

FIGS. 9 and 10 illustrate another embodiment of business form according to the invention, shown generally by reference numeral 60. The form 60 is a quadrate paper sheet/substrate which typically has a size of about 8½ by 11 inches, having first and second end edges 61, 62, first and second side edges 63, 64 and preferably an intermediate fold/perforation line 65. The perforation line 65 bisects the top face 66 of the form 60 into first and second portions 67, 68, respectively. The form 60 also has a second face 69 (see FIG. 10), and indicia 70 is imaged on the second face 69. Indicia 71 is also imaged on the top face 66, particularly on an uncoated portion 72 thereof, and preferably at least some of the indicia 71 is the same as at least some of the indicia 70.

Disposed on the first portion 67 of top face 66 is a CB coated strip 73, while provided on the second portion 68 is a CF coated strip 74. The strips 73, 74 are the same type as described earlier with respect to the FIGS. 1 through 8 embodiment. The coatings 73, 74 are spaced equidistant from the fold line 75 and the end edges 61, 62.

In a typical utilization of the form 60, it is passed through a duplex printer (such as an IBM 3828 laser printer with MICR encoding capabilities), where the indicia 70, 71 is imaged without adversely affecting the CB and CF coating 73, 74. For example, the indicia 70, 71 may be indicia for a bank check or the like. When the form 60 is then used in the field, it is folded about the fold line 65 with the coatings 73, 74 in face to face engagement with each other, and information on the bottom face 69 associated with the indicia 70, may be filled in by handwriting, a typewriter, or the like. The indicia so imprinted is transferred to the coating 74, so that the portion 68 provides a record portion when the form 60 is detached about the fold line 65, and the portion 67 given to the recipient.

It will thus be seen that according to the present invention an advantageous label, combination of label and container for prescription medicine, and method of associating a label with a container, have been provided. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent products and methods.

What is claimed is:

1. A label comprising:

a face stock having top and bottom faces;

pressure sensitive adhesive on at least a major portion of said bottom face;

a release liner engaging said pressure sensitive adhesive;

a CB coating on a first portion of said top face;

a CF coating on a second portion of said top face; and a first fold line formed in said face stock and release liner between said first and second portions, for allowing said face stock and release liner to be folded about said first fold line so that said CB coating comes into face-to-face contact with said CF coating.

2. A label as recited in claim 1 wherein said face stock comprises an uncoated third portion distinct from said first and second portions, and a slit formed in said face stock, but not said release liner, separating said third portion from said first and second portions; and further comprising a second fold line formed in said release liner underlying or adjacent said third portion of said face stock, said second and first fold lines allowing Z-folding of said release liner to bring said CB and CF coatings beneath said third portion so that indicia written on said third portion is transferred to said second portion.

3. A label as recited in claim 2 wherein said first and second portions are substantially immediately adjacent each other, and are separated by said first fold line, and wherein said third portion is substantially immediately adjacent said first portion, on the opposite side of said first portion from said second portion, and separated from said first portion by said slit.

4. A label as recited in claim 2 wherein said pressure sensitive adhesive is provided on said bottom face of all of said first, second, and third portions of said face stock.

5. A label as recited in claim 2 further comprising corresponding pre-printed indicia provided on said second and third portions, and spaced along said face stock so that said pre-printed indicia on said second portion underlies the corresponding preprinted indicia on said third portion when said release liner is Z-folded about said first and second fold lines.

6. A label as recited in claim 5 wherein said second fold line is spaced from said slit, and underlies said third portion.

7. A label as recited in claim 1 wherein said face stock comprises an uncoated third portion distinct from said first and second portions; and further comprising a second fold line formed in said release liner underlying or adjacent said third portion of said face stock, said second and first fold lines allowing Z-folding of said release liner to bring said CB and CF coatings beneath said third portion so that indicia written on said third portion is transferred to said second portion.

8. A label as recited in claim 7 further comprising corresponding pre-printed indicia provided on said second and third portions, and spaced along said face stock so that said pre-printed indicia on said second portion underlies the corresponding preprinted indicia on said third portion when said release liner is Z-folded about said first and second fold lines.

9. A label as recited in claim 7 wherein said pressure sensitive adhesive is provided on said bottom face of all of said first, second, and third portions of said face stock.

10. A label as recited in claim 7 wherein said first and second portions are substantially immediately adjacent each other, and are separated by said first fold line, and wherein said third portion is substantially immediately adjacent said first portion, on the opposite side thereof from said second portion.

11. A label as recited in claim 1 wherein said CB and CF coatings are capable of withstanding heat applied by a laser printer without significant damage to the image transferring ability thereof.

12. A label as recited in claim 1 wherein said first and second portions are substantially immediately adjacent each other, and are separated by said first fold line.

13. A label as recited in claim 12 wherein said first and second portions each have a first width along a portion thereof, and thin down to a second width, substantially less than said first width, at said first fold line.

14. A label as recited in claim 1 having first and second substantially parallel long edges, and first and second substantially parallel short edges, and further comprising adjacent identical labels connected to said first and second long edges, forming part of an integral sheet, and first and second lines of weakness formed in said sheet at said first and second long edges, respectively, defining said sheet into individual labels.

15. A label as recited in claim 14 wherein said first and second portions are substantially immediately adjacent each other, separated by said first fold line, and wherein said first fold line is parallel to said short edges; and further comprising means defining polygonal shaped cutouts in said sheet at said first fold line so as to define each of said first and second portions so that they have a first width along a portion thereof, and thin down to a second width, substantially less than said first width, at said first fold line.

16. A combination of a container and a label, comprising:

a container for prescription medicine; and a label connected to said container, said label comprising:

a face stock having top and bottom faces; a pressure sensitive adhesive on said bottom face; a first portion of said top face having a CB coating; a second portion of said top face having a CF coating, said second portion substantially immediately adjacent said first portion and separated by a first fold line; a third portion substantially immediately adjacent said first portion on the opposite side thereof from said second portion, and separated from said first portion by a slit; a release liner covering said first and second portions, and including said first fold line, and also including a second fold line underlying said third portion and spaced from said slit; said label folded about said first and second fold lines to provide a tab portion of said third portion between said slit and said second fold line, said tab portion having the second face thereof in engagement with said container, so that the pressure sensitive adhesive on said bottom face of said tab portion attaches said label to said container; and said release liner, with attached first and second portions, Z-folded about said first and second fold lines so that said CB and CF coatings underlie part of said third portion, remote from said tab portion, so that indicia written on said third portion is transferred to said second portion.

17. A combination as recited in claim 16 wherein said first fold line is a perforation line.

18. A combination as recited in claim 18 wherein said label further comprises corresponding pre-printed indicia provided on said second and third portions, and spaced along said face stock so that said pre-printed indicia on said second portion underlies the corresponding pre-printed indicia on said third portion when said release liner is Z-folded about said first and second fold lines.

19. A combination as recited in claim 18 wherein said container comprises a bottle.

20. A combination as recited in claim 18 wherein said preprinted indicia includes a line and associated alphanumeric indicia for a doctor's name, a line and associated alphanumeric indicia for a patient's name, and a line and associated alphanumeric indicia for a date.

21. A method of associating a label with a container for prescription medicine, utilizing a sheet containing a plurality of labels each having a face stock, pressure sensitive adhesive on the bottom face of the face stock, and a release liner, and a CB coating on a first portion of the top face of the face stock, a CF coating on a second portion of the top face of the face stock, and an uncoated third portion of the top face of the face stock, and using a non-impact printer which applies heat during the printing process, the method comprising the steps:

(a) passing the sheet through the printer to image variable information on the third portion of the face stock, without significantly adversely affecting the image transfer ability of the CB and CF coatings; then (b) separating one of the labels of the sheet from the rest of the sheet; then (c) exposing a part of the adhesive on the bottom face of part of the third portion of the label face stock by separating it from the release liner thereat;

(d) Z-folding the label so that the CB and CF coatings underlie a part of the third portion of the label;

(e) pressing the exposed part of the adhesive onto the container for prescription medicine; and (f) handwriting indicia on the part of the third portion of the label overlying the first and second portions so that the written indicia is transferred to the second portion; then (g) detaching the first and second portions from the third portion; and (h) removing the release liner from the entire third portion, and pressing the adhesive thereon into association with the container.

22. A method as recited in claim 21 comprising the further step (i), prior coating of the first and second portions with the CB and CF coatings, of imaging corresponding static indicia on that part of the third portion that overlies the second portion, and that part of the second portion that it overlies, so that the static indicia are in alignment after the practice of step (d).

23. A method as recited in claim 22 wherein step (i) is practiced by imaging as the corresponding static indicia, on both the second and third parts, indicia which includes a line and associated alphanumeric indicia for a doctor's name, a line and associated alphanumeric indicia for a patient's name, and a line and associated alphanumeric indicia for a date.

24. A label having first and second substantially parallel long edges, and first and second substantially parallel short edges, comprising:

a face stock having top and bottom faces;

pressure sensitive adhesive on at least a major portion of said bottom face;

a release liner engaging said pressure sensitive adhesive;

a CB coating on a first portion of said top face;

a CF coating on a second portion of said top face;

adjacent identical labels connected to said first and second long edges, forming part of an integral sheet, and first and second lines of weakness formed in said sheet at said first and second long edges, respectively, defining said sheet into individual labels;

wherein said first and second portions are substantially immediately adjacent each other, separated by said first fold line, and wherein said first fold line is parallel to said short edges; and means defining polygonal shaped cutouts in said sheet at said first fold line so as to define each of said first and second portions so that they have a first width along a portion thereof, and thin down to a second width, substantially less than said first width, at said first fold line.

* * * * *